US005372354A

United States Patent [19]

Cacicedo

[11] Patent Number: 5,372,354

[45] Date of Patent: Dec. 13, 1994

[54] PICKET FENCE PERMITTING ADJACENT SECTIONS TO BE ORIENTED ANGULARLY

[76] Inventor: Paulino A. Cacicedo, 5 Tisbury Ct., Scotch Plains, N.J. 07076

[21] Appl. No.: 98,110

[22] Filed: Jul. 28, 1993

[51] Int. Cl.[5] ..... E04H 17/16

[52] U.S. Cl. ..... 256/22; 256/24; 256/65

[58] Field of Search ..... 256/22, 24, 26, 59, 256/65

[56] References Cited

U.S. PATENT DOCUMENTS 3,339,895 9/1967 Kusel et al. ..... 256/24
3,352,084 11/1967 Seery ..... 256/65
3,892,387 7/1975 Mann ..... 256/24
4,712,773 12/1987 Larson ..... 256/26

FOREIGN PATENT DOCUMENTS 0007396 of 1910 United Kingdom ..... 256/22
91/04383 4/1991 WIPO ..... 256/65

*Primary Examiner*—Edward K. Look
*Assistant Examiner*—Mark Sgantzos
*Attorney, Agent, or Firm*—R. Gale Rhodes, Jr.

[57] ABSTRACT

A picket fence including posts, rails and pickets mounted to the rails, the upper rail is mounted removably to the posts and the lower rail is mounted removably and rotatably to the posts.

4 Claims, 4 Drawing Sheets

FIG. 5
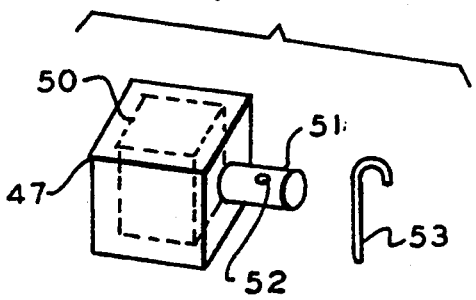
FIG. 6
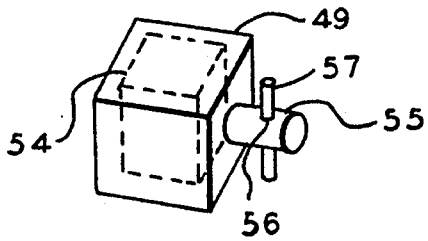
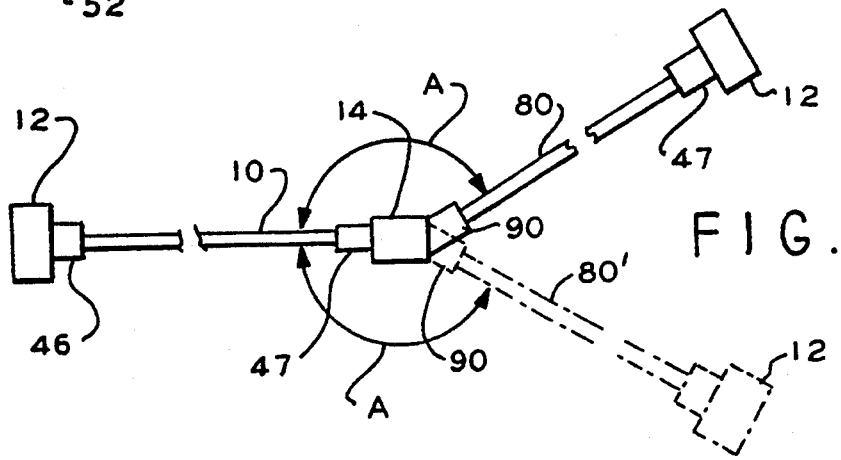
FIG. 8
FIG. 9
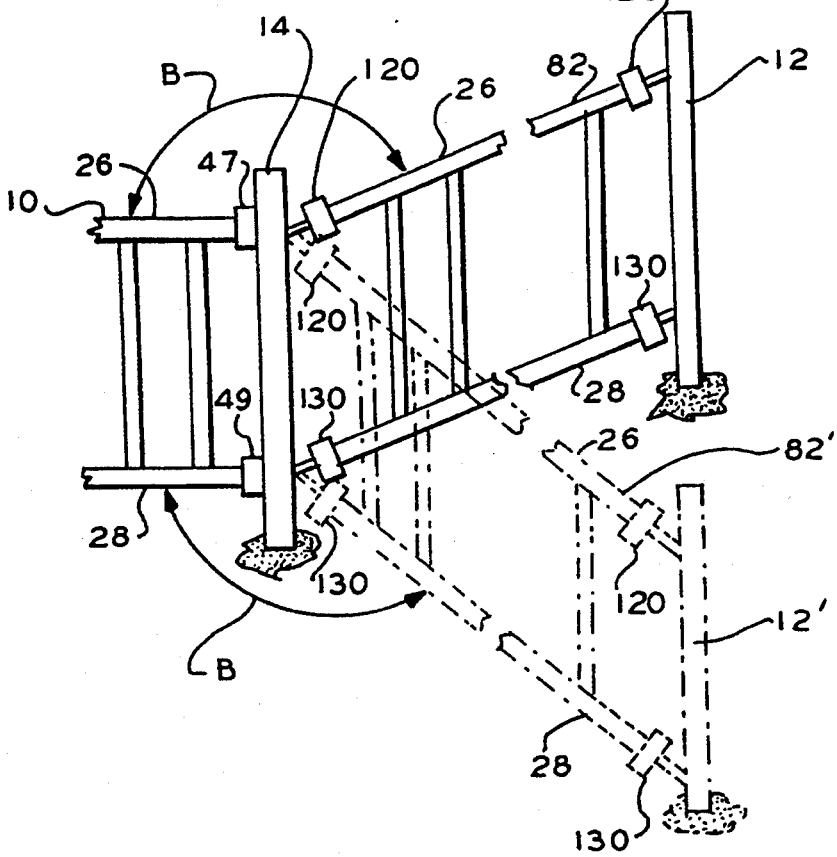

PICKET FENCE PERMITTING ADJACENT SECTIONS TO BE ORIENTED ANGULARLY

BACKGROUND OF THE INVENTION

This invention relates to a new and improved picket fence and more particularly relates to a new and improved picket fence including posts, rails and pickets which, after the posts are mounted vertically by having their bottoms fixed in the ground such as being set in concrete footings, may be simply and quickly assembled using primarily only a person's hands and with minimal use of hand tools. Still more particularly, this invention relates to a new and improved picket fence including a plurality of sections wherein adjacent sections share a common post and which sections may be oriented at an angle, laterally or vertically, with respect to each other.

Numerous picket fences are known to the prior art. U.S. Pat. No. 4,723,760, patented Feb. 9, 1988, entitled PICKET FENCE ASSEMBLY, William O. Sullivan inventor, discloses an adjustable picket fence assembly constructed in sections including posts, rails and pickets and wherein assembly is accomplished by providing the rails with interior apertured flaps for receiving rods extending through the rails to which crossing pickets are interlocked. U.S. Pat. No. 4,951,925, patented Aug. 28, 1990, entitled FENCE CONNECTOR ASSEMBLY, David H. Schultz et al. inventors, and U.S. Pat. No. 4,982,933, patented Jan. 8, 1991, entitled FENCE CONNECTOR CLIP AND ASSEMBLY, David H. Schultz inventor, disclose a fence and connector assembly which may be mounted on level or uneven terrain and which includes posts and rails and connector clips for attaching the rails to the posts; the latter patent is a continuation-in-part of the earlier patent. U.S. Pat. No. 4,923,176, patented May 8, 1990, entitled FENCE ANGULAR CONNECTOR ASSEMBLY, David E. Heinz inventor, discloses a fence connector assembly provided with a connector bracket defining a vertical cavity for receiving a fence post, vertically oriented laterally extending side members project from each side of the bracket, and a swivel bracket including a pair of spaced legs connected by a convex bearing portion engages the side members so that the legs form a rail receiving pocket therebetween; the bearing portion has a horizontally elongated slot and a lock fastener extends through the slot into threaded engagement with the connector bracket enabling the swivel bracket to be swivelable to selected positions thereby allowing selected orientation of a rail relative to the connector bracket and a post.

There exists a need in the picket fence art for a more simple picket fence which may be readily assembled by a person, preferably substantially manually without the requirement of hand tools, and picket fence is relatively inexpensive to manufacture.

SUMMARY OF THE INVENTION

It is the object of the present invention to satisfy the foregoing need in the fence art.

A picket fence satisfying such need and embodying the present invention includes posts, rails and pickets mounted to the rails, the upper rail is mounted removably to the posts and the lower rail is mounted removably and rotatably to the posts.

DESCRIPTION OF THE DRAWINGS

FIG. 5 is a perspective view of one end cap comprising the present invention and FIG. 6 is a perspective view of another end cap comprising the picket fence of the present invention;

FIG. 8 is a partial top or plan diagrammatical view illustrating the manner in which picket fence sections of the present invention may be oriented laterally at an angle with respect to each other;

FIG. 9 is a partial elevational or side diagrammatical view illustrating the manner in which picket fence sections of the present invention may be oriented vertically at an angle with respect to each other;

DESCRIPTION OF THE PREFERRED EMBODIMENT

Figure 4:
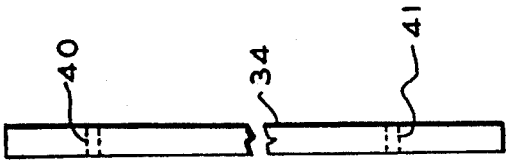
FIG. 4 is a partial elevational view of a picket comprising the picket fence of the present invention.
Figure 1:
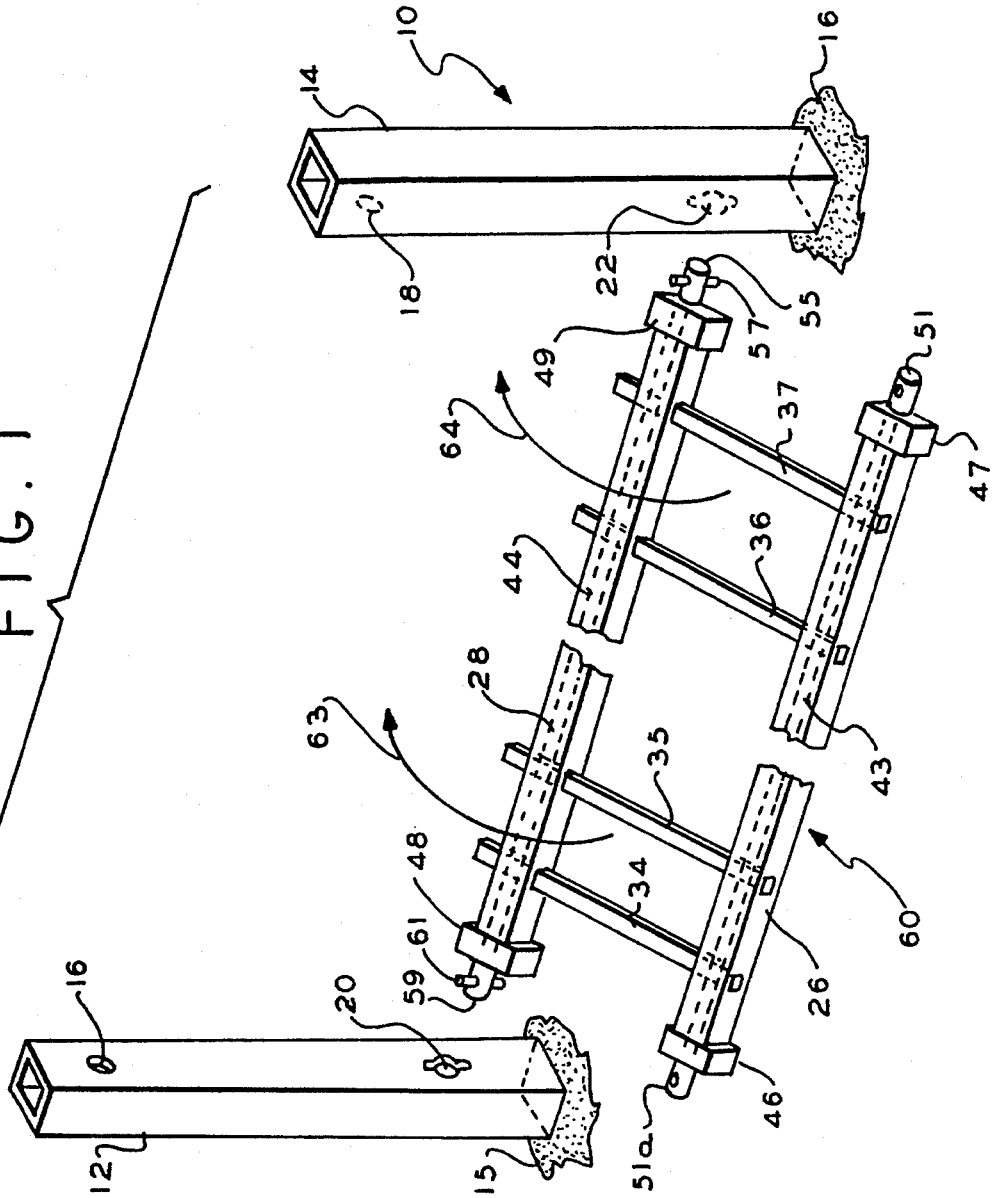
FIG. 1 is an exploded perspective view of a picket fence, or section thereof, embodying the present invention.
Figure 7:
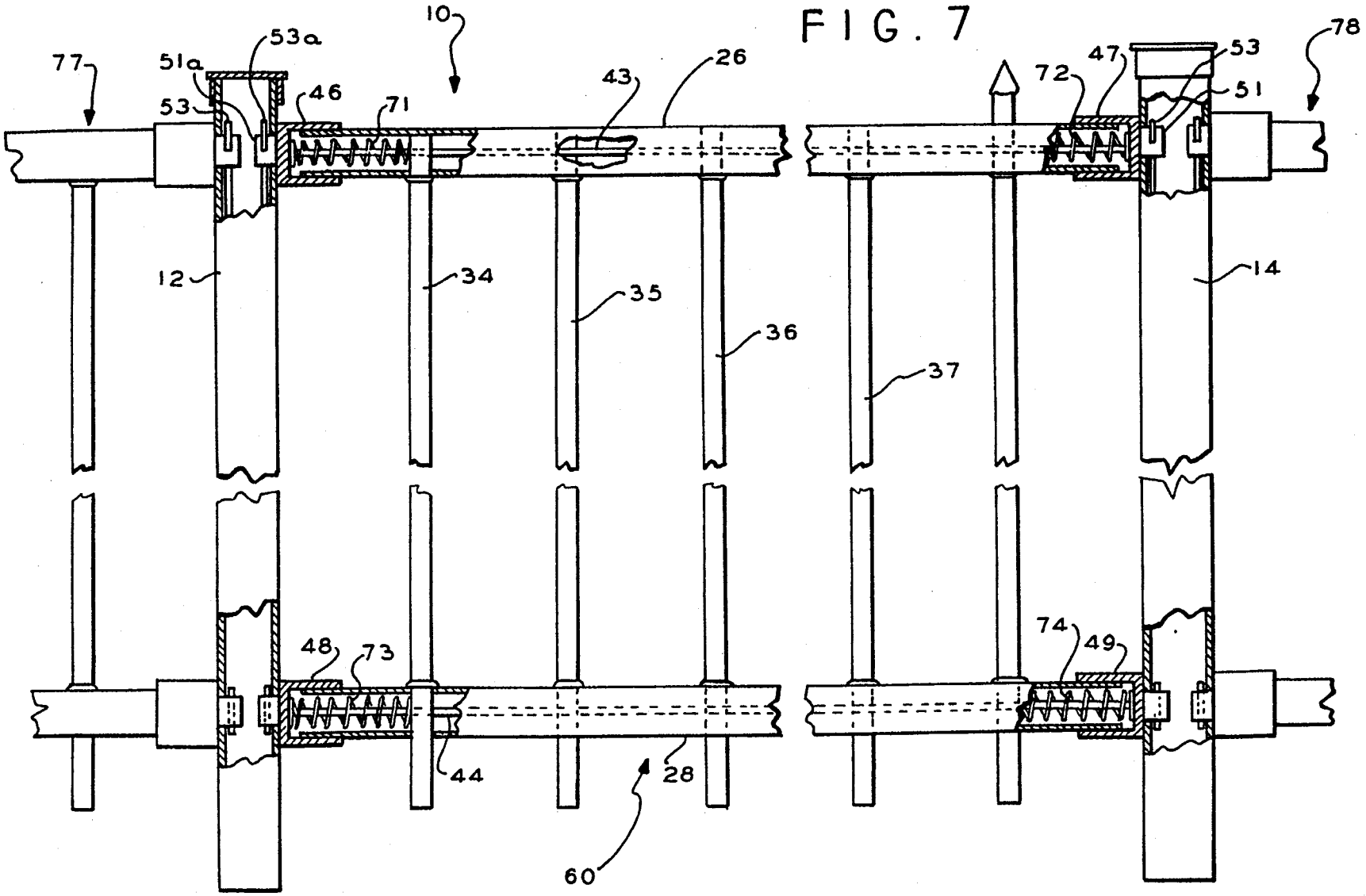
FIG. 7 is an elevational view of an actual embodiment of the picket fence of the present invention, or a section or portions of sections thereof, with portions of the fence being broken away to show underlying members some of which are shown in cross-section.

Referring to the drawings generally and in particular to FIGS. 1 and 7, a picket fence, or a section thereof, embodying the present invention, is illustrated and indicated by general numerical designation 10. Picket fence 10 includes a pair of tubular posts 12 and 14, rectangular in transverse cross-section, for being mounted vertically and spaced apart horizontally by, for example, having the lower portions embedded or set in concrete footings 15 and 16. The upper portions of the posts 12 and 14 are provided with a pair of circular openings 16 and 18 and the lower portions of the posts are provided with a pair of openings 20 and 22; although not shown in FIG. 1, it will be understood that the posts 12 and 14 are also provided with openings 16 and 18 and 20 and 22 on the sides thereof opposite to the sides shown in FIG. 1 in which such numbered openings are formed; the correspondingly numbered openings formed on the opposite sides are aligned vertically. Upon the posts 12 and 14 being mounted vertically as shown, upper openings 16 and 18 are placed in opposition, and lower openings 20 and 22 are placed in opposition. It will be noted, particularly from FIG. 2, that representative lower opening 22 includes a generally circular central portion 23 and vertically upwardly and downwardly extending portions 24 and 25; it will be understood that the opening 20 formed in the lower portion of post 12 is identical to opening 23. Referring again to FIGS. 1 and 7, picket fence 10 further includes upper and lower tubular rails 26 and 28, rectangular in transverse cross-section, for being mounted horizontally and parallel between the posts and spaced apart vertically. As may be understood from FIG. 3, and by reference to a portion of representative rail 26, the rails are provided with a plurality of vertically aligned rectangular paired openings such as vertically aligned paired openings 29—29, 30—30, and 31—31; such rectangular paired openings are sized to receive the tubular pickets 34–37 which are rectangular in transverse cross-section. Picket 34 is shown in detail in FIG. 4 and is provided with a pair of passageways 40 and 41 extending therethrough horizontally and spaced apart vertically. It will be generally understood, FIGS. 1 and 7, that the pickets 34–37 extend vertically through the pairs of paired openings formed in the rails 26 and 28 and that the pickets are mounted vertically to the rails and spaced apart horizontally therealong by such pairs of paired openings and by a pair of elongated picket mounting rods 43 and 44, shown in dashed line in FIG. 1 and shown in solid and dashed lines in FIG. 7. The rods 43 and 44 reside internally of the tubular rails 26 and 28 and extend through the passageways formed in the pickets, such as passageways 40 and 41 shown in FIG. 4. In the preferred embodiment, the picket mounting rods 43 and 44 and the passageways extending horizontally through the pickets, e.g. passageways 40 and 41 shown in FIG. 4, are circular in transverse cross-section.

End caps 46 and 47, FIG. 1, are mounted at the opposed end portions of the upper rail 26 and end caps 48 and 49 are mounted at the opposed end portions of the lower rail 28; as described in detail below and as shown in detail in FIG. 7, it will be generally understood that the end caps are spring biased outwardly, as shown in FIG. 7, to facilitate mounting of the rails to the posts. More particularly, and referring to FIG. 7, it will be understood that compression springs 71, 72, 73 and 74 are mounted internally of the end portions of the tubular rails 26 and 28 the end caps 46, 47, 48 and 49 and the next adjacent pickets such as pickets 34 and 37. Such springs, as shown in FIG. 7, reside partially in the end caps and partially in the opposed end portions of the rails.

End cap 47, FIG. 5, is provided with a recess 50 complementary in shape to and for receiving an end portion of the rail 26 (FIG. 1) and is provided with an outwardly extending cylindrical member 51 for being received removably within the opening 18 (FIG. 1) formed in the upper portion of the post 14. Cylindrical member 51 is provided with a passageway 52 extending transversely therethrough and which passageway is for receiving the hook-shaped end cap mounting pin 53 to removably mount the end cap 47, and the end portion of the upper rail 26 received within the recess 50, to the post 14 as shown in detail in FIG. 7. End cap 46, FIG. 1, has the same shape as end cap 47 and is provided with an outwardly extending cylindrical member 51*a* which is also provided with a passageway extending therethrough (not shown in FIG. 1) for receiving a hook-shaped mounting pin, such as pin 53 shown in FIG. 5, to removably mount the end cap 46, and thereby the end portion of the upper rail 26 received within the end cap 46 removably to the post 12, as shown in FIG. 7.

End cap 49, FIG. 6, is provided with a recess 54 complementary in shape to and for receiving an end portion of the rail 28 (FIG. 1) and is provided with an outwardly extending cylindrical member 55 provided with a passageway 56 extending transversely therethrough. Mounted suitably fixedly in the passageway 56 is an end cap mounting pin 57 with the ends thereof extending outwardly and transversely of the cylindrical member 51 as shown in FIG. 6. The cylindrical member 55 and the ends of the end cap mounting pin 57 are for being received rotatably and removably in the opening 22 (FIG. 1) formed in the lower portion of the post 14 to removably and rotatably mount the end cap 49, and the end portion of the lower rail 26 received therein, to the post 14. End cap 48, FIG. 1, has the same shape as end cap 49 and is provided with an outwardly extending cylindrical member 59 having an end cap mounting pin 61 fixedly secured in a passageway (not shown) extending through the cylindrical member 59 with the ends thereof extending outwardly and transversely of the cylindrical member 59 as shown in FIG. 1. The cylindrical member 59 and the ends of the end cap mounting pin 61 are for being received within the opening 20 to mount the end cap 48, and the end portion of the lower rail 28 received therein, to the post 12.

Figure 2:
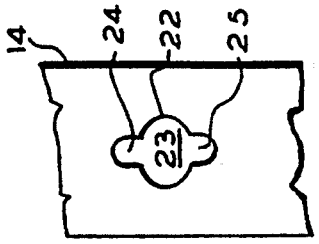
FIG. 2 is a partial elevational view of the lower portion of one of the posts comprising the picket fence of the present invention illustrating the shape of a rail mounting opening formed therein.
Figure 3:
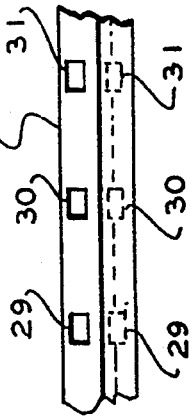
FIG. 3 is a partial perspective view of a portion of one of the rails comprising the picket fence of the present invention and illustrating vertically aligned pairs of paired openings for receiving pickets.

For assembly, and referring again to FIG. 1, the rails 26 and 28, pickets 34–37, and end caps 46–49 are assembled as shown in FIG. 1, and as discussed generally above, to form the assembly indicated by general designation 60, and the assembly 60 is oriented substantially horizontally, or at substantially 90° with respect to the vertical posts 12 and 14, to place the end caps 48 and 49 generally opposite the openings 20 and 22 formed in the lower portions of the posts 12 and 14 and in particular to orient the outwardly extending ends of the end cap mounting pins 57 and 61 vertically in the same orientation as the upwardly and downwardly extending portions of the openings 22 and 20 formed in the lower portions of the posts 12 and 14 (note upwardly and downwardly extending portions 24 and 25 of opening 22 shown in FIG. 2). The end caps 48 and 49 are then forced inwardly against the action of the compression springs 73 and 74 shown in FIG. 7 to permit the cylindrical members 55 and 59 provided on the end caps 48 and 49 to be inserted or snap-fitted into the circular portions of the openings 20 and 22 (note circular portion 23 of opening 22 shown in FIG. 2) and to permit the outwardly extending end portions of the end cap mounting pins 57 and 61 to be inserted or snap-fitted into the upwardly and downwardly extending portions of the openings 20 and 22. The assembly 60, FIG. 1, is then rotated substantially 90° upwardly as indicated by the arrows 63 and 64 cause the outwardly extending ends of the end cap mounting pins 57 and 61 to reside behind solid portions of the lower portions of posts 12 and 14 to place the end caps 46 and 47 generally opposite the openings 16 and 18 formed in the upper portions of the posts 12 and 14. The end caps 46 and 47 are then forced inwardly against the action of the compression springs 71 and 72, FIG. 7, to insert or snap-fit the outwardly extending cylindrical members 53 and 52 into the circular openings 16 and 18 formed in upper portions of the posts 12 and 14. Hook-shaped end cap retaining pins 53 and 53*a*, FIG. 7, are then inserted downwardly through the open top portions of the posts 12 and 14 and into the passageways, e.g. passageway 51 shown in FIG. 5, formed in the cylindrical members 51 and 51*a* to mount the end caps 46 and 47, and thereby the opposed end portions of the upper rail 26 received therein, removably to the posts 12 and 14. The picket fence 10 is then fully assembled as shown in FIG. 7; it will be understood that numerical designation 10 also refers to what may be considered to be a section of the picket fence of the present invention. To disassemble the assembly 60 from the posts 12 and 14 the above-described assembly process is merely reversed.

Referring again to FIG. 7, it will be noted that the picket fence of the present invention may also include or be comprised of additional sections such as sections indicated by general numerical designations 77 and 78 in FIG. 7 and partially shown therein. it will be noted that additional section 77 shares post 12 in common with section 10 and that additional section 78 shares post 14 in common with section 10, and it will be further understood that additional sections 77 and 78 are mounted to posts 12 and 14 in the same manner as the assembly 60 as described above. It will be further understood from FIG. 7 that such additional sections 77 and 78 extend linearly or generally in a straight line with respect to section 60. However, it will be understood that the picket fence 10 of the present invention also includes sections which may be mounted at a predetermined angle, such as for example 45°, with respect to another section, to permit the picket fence of the present invention to extend in other than a straight line or linearly.

More particularly, and referring to FIG. 8, it will be understood that the picket fence of the present invention may include a first section 10 mounted between post 12 and a common post 14 and an additional section 80, shown in solid outline in FIG. 8, mounted between common post 14 and a post 12. It will be noted that section 80 is mounted to common post 14 at a predetermined angle A, e.g. 45° laterally leftwardly with respect to section 10. Alternatively, instead of including the additional section 80 shown in solid outline in FIG. 8, the picket fence of the present invention may include an additional section 80' shown in dashed outline in FIG. 8 and section 10 of FIG. 8 may be mounted at the predetermined angle A laterally rightwardly with respect to an additional section 80' which section 80' is mounted between common post 14 and post 12. It will be further understood from FIG. 9 that the picket fence of the present invention may be mounted on uneven or hilly terrain, terrain other than substantially flat terrain, and may include a section 10 having one end mounted to the common post 14 and a section 82, shown in solid outline, mounted between the common post 14 and a post 12. The section 82 is mounted to the common post 14 vertically upwardly with respect to a section 10 at the predetermined angle B. Alternatively, instead of including the additional section 82 shown in solid outline in FIG. 9 the picket fence of the present invention may include an additional section 82', shown in dashed line in FIG. 9 mounted between the common post 14 and a post 12 and mounted vertically downwardly with respect to the section 10 at the predetermined angle B, e.g. 45°. It will be generally understood that the additional alternative sections 80 and 80' shown in FIG. 8 and 82 and 82' shown in FIG. 9 are comprised of substantially the same structural elements as the section 10, or assembly 60, shown in FIG. 1, except for certain angle end caps as described in detail below.

Figure 10:
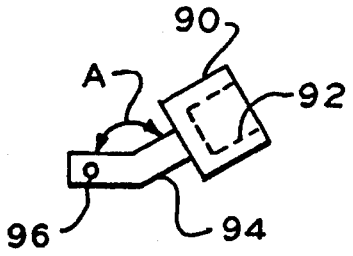
FIGS. 10 and 11 are top or plan views of angle end caps of the present invention.
Figure 11:
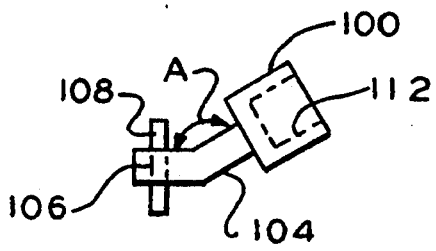

The picket fence of the present invention may further include an angle end cap 90 shown in FIG. 10 which is provided with a recess 92 for receiving an end portion of an upper rail of the present invention, such as upper rail 26 shown in FIG. 1, and angle end cap 90 includes an outwardly extending angular cylindrical member 94 provided with the predetermined angle A, e.g. 45°, in which is formed a transversely extending passageway 96 for receiving a hook-shaped end cap mounting pin such as pin 53 shown in FIG. 5. Accordingly, it will be understood that the angle end cap 90 of FIG. 10 is mounted to a post of the present invention in the same manner that the end cap 50 shown in FIG. 5 is mounted to a post of the present invention and as was described above. In addition, the picket fence of the present invention includes angle end cap 100 shown in FIG. 11, which end cap 100 is provided with a recess 112 for receiving an end portion of a lower rail of the present invention, such as for example lower rail 28 shown in FIG. 1, and the angle end cap 100 includes a generally cylindrical outwardly extending angular portion 104 provided with the predetermined angle A, e.g. 45°, through which a passageway 106 extends transversely therethrough. Mounted suitably fixedly in the passageway 106 is an end cap mounting pin 108 having the ends thereof extending outwardly and transversely with respect to the angular cylindrical member 104. Accordingly, it will be understood that the angle end cap 100 shown in FIG. 11 is mounted to a post of the present invention in the same manner that the end cap 47 shown in FIG. 5 is mounted to a post of the present invention and as was described above.

Referring again to FIG. 8, a diagrammatical top view, it will be understood that the upper and lower rails of the present invention comprising section 10, although not shown in FIG. 8, are mounted to the post 12 and common post 14 by the end caps 46 and 47 and 48 and 49 of the present invention as shown in FIG. 7 and described above. It will be further understood that the rightward end of the rails of the present invention comprising section 80, although not shown in FIG. 8, are mounted to the post 12 by, for example, end caps 47 and 49 in the same manner that the rightward ends of the rails 26 and 28 are mounted to post 14 shown in FIG. 7. It will be still further understood that the leftward ends of the upper and lower rails of the present invention comprising section 80 are mounted, respectively, rotatably and removably to the common post 14 by the angle end caps 90 and 100 shown respectively in FIGS. 10 and 11. More particularly, it will be understood that the angle end cap 90 shown in FIG. 8 is mounted removably to the common post 14 in the same manner that end cap 47 is mounted to the common post 14 and it will be still more particularly understood that the angle end cap 100, not shown in FIG. 8 but residing below the angle end cap 90 which is shown in FIG. 8, is mounted removably and rotatably to the common post 14 in the same general manner that the end cap 49 is mounted removably and rotatably to the post 14 shown in FIGS. 1 and 7. Accordingly, it will be understood that the angle end caps 90 and 100 will occupy, in plan or top view, the orientations shown by the plan views thereof in FIGS. 10 and 11. Angle end caps 90 and 100 may be used also to mount the additional alternative section 80' shown in dashed outline in FIG. 1 laterally rightwardly with respect to the section 10 in the same general manner that the end caps 90 and 100, as described above, are utilized to mount the additional section 80 laterally leftwardly with respect to the section 10. However, in mounting the alternative additional section 80' to the common post 12 as shown in FIG. 8, the angle end caps 90 and 100 will be rotated 180° from the positions shown in FIGS. 10 and 11 and will occupy positions having the plan or top views shown in FIGS. 12 and 13.

Figure 12:
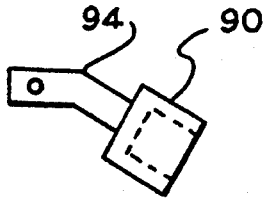
FIGS. 12 and 13 are also top or plan views of the angle end caps shown in FIGS. 10 and 11 but the views thereof shown in FIGS. 12 and 13 are reversed with respect to the views shown in FIGS. 10 and 11.
Figure 13:
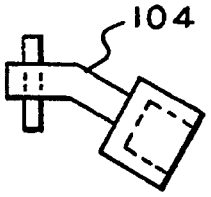
Figure 14:
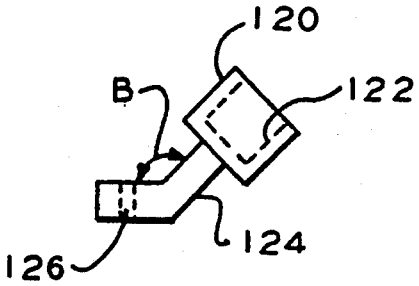
FIGS. 14 and 15 are side or elevational views of other angle end caps of the present invention and FIGS. 16 and 17 are also side or elevational views of the angle end caps shown in FIGS. 14 and 15 but the views thereof shown in FIGS. 16 and 17 are reversed with respect to the views shown in FIGS. 14 and 15.
Figure 15:
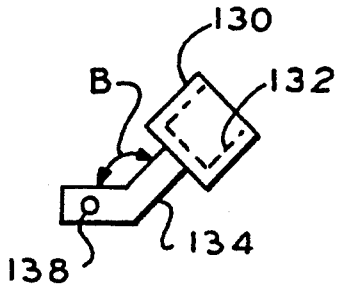

The picket fence of the present invention may further include angle end cap 120, shown in FIG. 14, which end cap 120 is provided with a recess 122 for receiving an end portion of an upper rail of the present invention, such as upper rail 26 shown in FIG. 1, and end cap 120 includes an outwardly extending angular cylindrical member 124 provided with the predetermined angle B, e.g. 45°, and a passageway 126 extends transversely through the angular cylindrical member 124 as shown in FIG. 12. Accordingly, it will be understood that the angle end cap 120 of FIG. 12 is mounted to a post of the present invention in the same manner that the end cap 50 shown in FIG. 5 is mounted to a post of the present invention and as described above. It will be noted that the passageway 96 formed in angle end cap 90 and the passageway 126 formed in angle end cap 120 are oriented 90° with respect to each other. The picket fence of the present invention further includes angle end cap 130 shown in FIG. 15 which end cap 130 is provided with a recess 132 for receiving an end portion of a lower rail of the present invention, such as lower rail 28 shown in FIG. 1. The end cap 130 includes an outwardly extending angular cylindrical member 134 provided with a predetermined angle B, e.g. 45°, and an end cap mounting pin 138 extends transversely through the angular cylindrical member 134 by being suitably fixedly mounted in a transverse passageway not shown in FIG. 13. Accordingly, it will be understood that the angle end cap 130 is mounted to a post of the present invention in the same general manner that the end cap 49 of FIG. 6 is mounted to a post of the present invention and as described above. It will be understood that the end cap mounting pins 108 and 138 shown in FIGS. 11 and 15 are oriented 90° with respect to each other.

Figure 17:
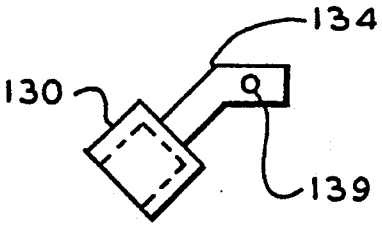
Figure 16:
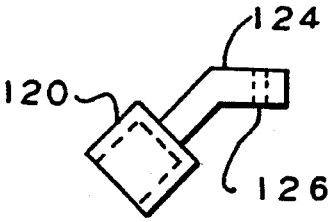

Referring again to FIG. 9, it will be understood that the rightward portions of upper and lower rails 26 and 28 comprising the section 10 are mounted to the common post 14 by end caps 47 and 49 in the same manner that end caps 47 and 49 are mounted to the post 12 in FIG. 7. The leftward ends of the upper and lower rails 26 and 28 comprising the alternative additional section 82 are mounted angularly to the post 13 by angle end caps 120 and 130 and in such mounting the angular end caps 120 and 130 will occupy positions so as to have the side or elevational views shown in FIGS. 14 and 15. It will be further understood that the rightward portions of the upper and lower rails 26 and 28 comprising the alternative additional section 82 will be mounted angularly to the post 12 by angular end caps 120 and 130 as illustrated in FIG. 9, but it will be understood that during such angular mounting the angle end caps 120 and 130 will occupy positions such that the side elevational views thereof will be as shown in FIGS. 16 and 17. Such angular mounting of alternative additional section 82 mounts orients such section at the predetermined angle B, e.g. 45° vertically upwardly with respect to the section 10.

Referring still to FIG. 9, it will be understood that the angle end caps 120 and 130 of the present invention may be used to mount the upper and lower rails 26 and 28 of the alternative additional section 82 to the common post 14 and the post 12' such that the section 82' is oriented vertically downwardly with respect to the section 10 at the predetermined angle B, e.g. 45°. In such mounting of section 82', it will be generally understood that the pairs of angle end caps 120 and 130 upon mounting the upper and lower rails 26 and 28 of section 82' angularly with respect to the common post 14 and post 12 occupy positions reversed to those shown in FIGS. 14 and 15 and FIGS. 17 and 18.

Referring again generally to the picket fence of the present invention, it will be understood that the tubular posts, tubular rails, and tubular pickets may be suitably extruded from a suitable material such as a suitable aluminum or aluminum alloy, and it will be further understood that the end caps of the picket fence of the present invention may be suitably cast from a suitable material such as a suitable aluminum or aluminum alloy. The compression springs shown in FIG. 7 may be suitable compression springs of the type generally commercially available. Also, as shown in FIG. 7, the posts of the present invention may be provided with suitable caps at their tops as shown in FIG. 7 which caps may be suitably cast from a suitable material such as a suitable aluminum or aluminum alloy. Similarly, the tops of the pickets, as shown in FIG. 7, may be provided with suitable caps, such as the pointed cap shown, which caps may also be suitably cast from a suitable material such as a suitable aluminum or aluminum alloy.

It will be further understood that many variations and modifications may be made in the present invention without departing from the spirit and the scope thereof.

What is claimed is:

1. Picket fence, comprising:

at least two tubular posts for being mounted vertically and spaced apart horizontally, said posts including upper and lower portions;

upper and lower tubular rails for being mounted horizontally and parallel between said posts and spaced apart vertically, said rails having a plurality of vertically aligned paired openings spaced horizontally along the lengths thereof, and said rails including opposed end portions;

a plurality of pickets for being mounted vertically to said rails and spaced apart horizontally along the lengths thereof, each of said pickets for residing in a vertically aligned pair of said paired openings formed in said rails and each picket provided with a pair of passageways extending therethrough horizontally and spaced apart vertically;

a pair of picket mounting rods for residing internally of said rails and for extending through said passageways formed in said pickets to mount said pickets to said rails;

a first pair of end caps for being mounted on said opposed end portions of said upper rail, said first pair of end caps provided with recesses complementary in shape to and for receiving said opposed end portions of said upper rail, and said first pair of end caps and said upper portions of said rail provided with first cooperative connecting means for mounting said first pair of end caps, and thereby said opposed end portions of said upper rail, removably to said posts; and a second pair of end caps for being mounted at said opposed end portions of said lower rail, said second pair of end caps provided with recesses complementary in shape to and for receiving said opposed end portions of said lower rail, and said second pair of end caps and said lower portions of said rails provided with second cooperative connecting means for mounting said second pair of end caps, and thereby said opposed end portions of said lower rail, rotatably and removably to said posts.

2. The picket fence according to claim 1 wherein said first cooperative connecting means comprise:

a first pair of outwardly extending members provided on said first pair of end caps and having passageways extending transversely therethrough, and a pair of openings formed in said upper portions of said posts complementary in shape to and for receiving said outwardly extending members provided on said first pair of end caps, and a first pair of end cap mounting pins for residing internally of said upper portions of said posts and for extending through said passageways formed in said outwardly extending members upon said outwardly extending members extending through said openings and residing internally of said posts; and wherein said second cooperative connecting means comprise:

a second pair of outwardly extending cylindrical members provided on said second pair of end caps and provided with passageways extending transversely therethrough, a second pair of end cap mounting pins extending through said passageways and mounted fixedly to said cylindrical members with the ends thereof extending outwardly from said cylindrical members, a second pair of openings formed in said lower portions of said posts and said openings including a generally circular central portion and vertically upwardly and downwardly extending portions, said pair of cylindrical members for being inserted through said circular central portions of said openings and said ends of said second pair of mounting pins for being inserted through said upwardly and downwardly extending portions of said openings to permit said second pair of end caps to be rotated approximately 90° with respect to said posts to cause said outwardly extending ends of said second pair of mounting rods to reside behind solid portions of said lower portions of said posts surrounding said second pair of openings.

3. The picket fence according to claim 1 wherein said picket fence further comprises at least first and second pairs of compression springs, said first pair of compression springs for partially residing in said recesses provided in said first pair of end caps and for partially residing in said opposed end portions of said upper rail and between said first pair of end caps and one of said pickets to spring bias said first pair of end caps outwardly to facilitate mounting of said first pair of end caps to said posts; and said second pair of compression springs for residing partially in said recesses provided in said second pair of end caps and partially in said opposed end portions of said lower rail and for being mounted between said second pair of end caps and one of said pickets to spring bias said second pair of end caps outwardly to facilitate said mounting of said end caps to said posts.

4. The picket fence according to claim 1 comprises a first section of said picket fence and wherein said picket fence includes at least a second section, wherein said first and second sections are both comprised of one of said posts which said one post is a common post, wherein said second section is for being connected to said common post at a predetermined angle with respect to said first section, wherein at least one end cap of each of said pair of end caps of said second section is an angle end cap including an angular portion for connecting said upper and lower rails to said common post at said predetermined angle.

* * * * *